United States Patent [19]

Waldrep

[11] Patent Number: 4,943,172

[45] Date of Patent: Jul. 24, 1990

[54] DRILL DECK BUSHING

[75] Inventor: William N. Waldrep, Midland, Tex.

[73] Assignee: Drilco Industrial, Inc., Midland, Tex.

[21] Appl. No.: 330,628

[22] Filed: Mar. 30, 1989

[51] Int. Cl.[5] ..... F16C 33/34; F16C 31/00

[52] U.S. Cl. ..... 384/565; 384/24; 384/29; 384/97; 175/220

[58] Field of Search ..... 384/10, 16, 24, 25, 384/29, 31, 37, 97, 567, 574, 581; 175/220

[56] References Cited

U.S. PATENT DOCUMENTS

| | | | |
|---|---|---|---|
| 2,958,563 | 11/1960 | Alexandroff | 384/581 |
| 3,097,895 | 7/1963 | Matt | 384/535 |
| 3,194,611 | 7/1965 | Mahony | 384/24 |
| 3,633,980 | 1/1972 | Hunt | 384/24 |
| 3,944,300 | 3/1976 | Learmont et al. | 384/29 |
| 3,951,470 | 4/1976 | McLean | 384/29 |
| 4,054,332 | 10/1977 | Bryan, Jr. | 384/24 |
| 4,076,338 | 2/1978 | Hisey | 384/24 |
| 4,186,973 | 2/1980 | Work | 384/24 |
| 4,324,438 | 4/1982 | Lister | 384/16 |
| 4,326,756 | 4/1982 | Moroz | 384/24 |

FOREIGN PATENT DOCUMENTS

| | | | |
|---|---|---|---|
| 8578 | of 1906 | United Kingdom | 384/37 |

*Primary Examiner*—Thomas R. Hannon

*Attorney, Agent, or Firm*—Ned L. Conley; David A. Rose; William E. Shull

[57] ABSTRACT

A shock absorbing roller deck bushing for rotary blast hole drills has a steel inner liner with a cylindrical axial bore for receiving a drill string. The liner is rotatably disposed within an outer shell mounted in the drill deck. A split retainer plate is attached to the outer shell and has an inwardly projecting flange around its inner periphery which is captured between a pair of radially outwardly projecting flanges around the outer periphery of the liner. The flanges permit limited lateral movement of the liner with respect to the outer shell, but prevent the liner from being removed axially from the shell. A plurality of shock absorbing cushion roller assemblies are mounted vertically in slotted cages between the liner and shell. The roller assemblies each include a shaft surrounded by a sleeve within a cushion coating bonded to the sleeve, with thrust washers between the ends of the sleeves and the cages. The roller assemblies are free to turn about their shafts and rotate with the liner, and to move radially of the deck bushing to a limited extent, when impacted by the liner. The roller assemblies absorb and dampen impact loads imparted to the liner by the drill pipe.

25 Claims, 3 Drawing Sheets

DRILL DECK BUSHING

BACKGROUND OF THE INVENTION

This invention relates to a rotary bushing for guiding a drill string of a blast hole drill, and more particularly to a bushing that is mountable in the deck or table of the blast hole drill and through which drill pipe passes for drilling into the earth.

The drill string of a conventional blast hole drill extends downwardly through an opening in the deck of a drilling machine. A tubular cylindrical guide bushing is mounted on the deck through which the drill string passes with a relatively close fit, the bushing serving to guide the drill string and also to provide a bearing and wear surface. Such deck bushings have heretofore generally been rigidly mounted with respect to the deck, as a result of which lateral vibrations emanating from the drill string are transmitted directly to the drilling machine.

Very substantial lateral vibrations can occur in a drill string, for example when the bit encounters hard rocks or other irregularities. As the drill string becomes longer, there can be very significant column bending of the string, and this can result in additional or magnified vibrations. Also, resonant conditions can occur at certain lengths and/or rotational speeds, again resulting in added or magnified lateral vibration. Where the bushing is rigid with respect to the deck, lateral vibrations are transmitted directly to the drilling machine and serious structural damage can result; there are many instances where vibrations have resulted in broken welds and other structural damage to the machine. Further, undampened vibrations cause excessive wear of the drill string sections or joints and drill bits, or result in wear or damage to the rotary driving head.

There are presently known rotary bearings which are mounted between the deck and drill pipe and consist of a metallic inner collar which rotates with the pipe and an outer collar fixed to the deck with ball bearings disposed in between. See, for example, U.S. Pat. No. 3,951,470. Such rotary bushings will reduce the wear on the drill string, but they are very expensive. Other pipe guides such as are shown in U.S. Pat. No. 3,194,611 utilize a plurality of rollers in the bushing which are encased with the pipe. See also U.S. Pat. Nos. 4,054,332; 4,076,338; and 4,326,756. Other patents teach a guide bushing having an elastomeric member or segments disposed within a collar and circumscribing the drill pipe. See, for example, U.S. Pat. Nos. 3,944,300 and 4,324,438. The guide bushings which provide rubber rings or collars often have the rings or collars bonded to their exterior surfaces. These may successfully dampen vibrations, but only for a very short time since they simply do not have the requisite mechanical strength. A particular problem in this regard is that the drill string also exerts rotational and vertical forces on the bushing, and these, with the lateral movements, result in a grinding action which can destroy the rubber rings or collars in a short period of time. Making the rubber harder may increase its life, but it also reduces its effectiveness in dampening vibrations. Further, the resilience of such bushings cannot be adjusted to meet varying conditions.

Guide bushings made entirely of metal are extremely noisy in operation and transmit excessive vibrations to the blast hole drill. Such metal bushings do not have a long service life and tend to rapidly wear the drill string.

U.S. Pat. No. 4,186,973 discloses a guide bushing mounted in a supporting sleeve in the deck of a blast hole drill for guiding a drill string through the sleeve. The bushing has a tubular core with a cylindrical axial bore to receive and guide the drill string. The core has a flange which is supported on the supporting sleeve, and there is a resilient, elastomeric cushion means mounted on the exterior of the core to serve as a cushion to soften and transfer movements of the bushing within the supporting sleeve. However, the tubular core is relatively stationary with respect to the supporting sleeve and does not rotate with the drill string, thereby causing excessive wear to the core.

The present invention is seen to have overcome these deficiencies of the prior act.

SUMMARY OF THE INVENTION

The present invention includes a shock absorbing roller deck bushing for rotary blast hole drills having a steel liner providing a cylindrical axial bore adapted to receive and guide the drill string. The steel liner is adapted to be rotatably disposed within an outer shell mounted in the deck of a blast hole drill. Means are provided for mounting the steel liner substantially coaxially in the outer shell while allowing relative transverse movements between the steel liner and outer shell. A plurality of resilient, elastomeric shock absorbing cushion rollers are mounted in a cage between the exterior of the steel liner and the interior of the outer shell. The cage is adapted to allow the cushion rollers to move radially to a limited extent and to contact the exterior of the steel liner and rotate therewith as the steel liner rotates with the drill pipe. The shock absorbing cushion covering of the rollers is adapted to coact with the exterior wall of the steel liner to cushion the relative transverse movements of the steel liner with respect to the outer shell.

Other objects and advantages of the present invention will appear from the following description.

BRIEF DESCRIPTION OF THE DRAWINGS

For a detailed description of a preferred embodiment of the invention, reference will now be made to the accompanying drawings wherein.

DESCRIPTION OF THE PREFERRED EMBODIMENT

Figure 1:
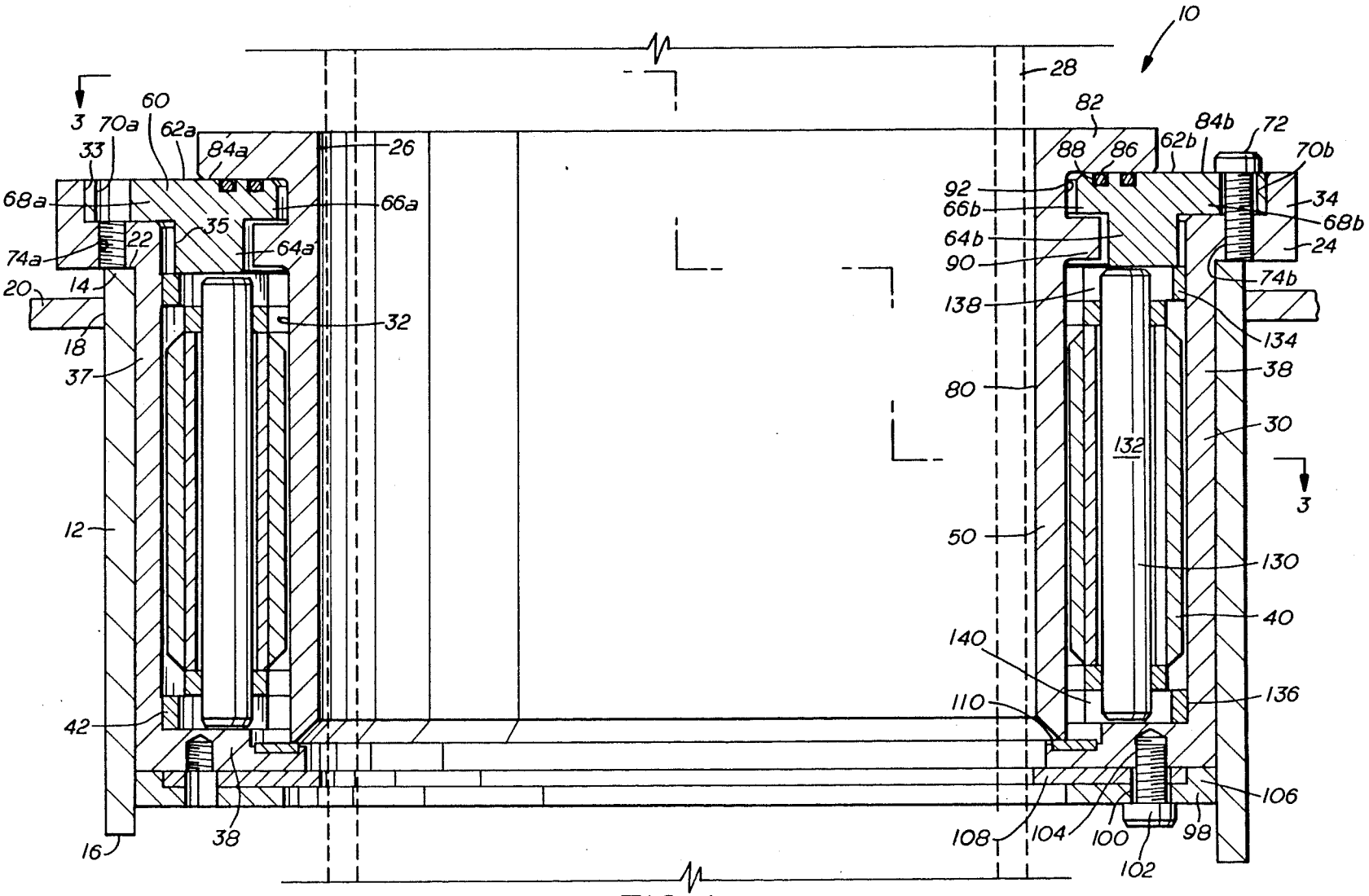
FIG. 1 is a vertical sectional view of the roller deck bushing of the present invention.

Referring initially to FIG. 1, the shock absorbing roller deck or guide bushing of the present invention, designated generally by the reference number 10, is shown disposed in a vertical cylindrical sleeve 12, sometimes called a guide bushing bucket. The cylindrical sleeve 12 is open at the top 14 and bottom 16 and is welded within a circular opening 18 in the deck plate 20 of a blast hole drill. The sleeve 12 projects slightly above the deck plate 20 and provides a rim 22 that extends above the deck plate 20. The roller deck bushing 10 includes an annular, generally tubular cylindrical outer shell 30 and an annular, generally tubular cylindrical inner steel liner 50 coaxially disposed within the outer shell. A plurality of vertically disposed, shock absorbing cushion roller means 40 are mounted in the annular space between outer shell 30 and inner liner 50. The outer shell 30 has at its top a radially outwardly extending annular flange 24 which rests on the rim 22 to support the guide bushing 10 within the deck sleeve 12. Alternatively, the top 14 of the deck sleeve 12 may be positioned substantially flush with the top of deck plate 20, in which case the flange 24 will rest in part on the deck plate 20, and in part on the rim 22.

A bore 26 within the steel liner 50 provides an opening for loosely journaling and vertically guiding a drill pipe 28 extending therethrough, shown in dashed lines in FIG. 1. Drill pipe 28 may be, for example, the drill pipe of a blast hole drill. The steel liner 50 rotates with the drill pipe 28 with the outer shell 30 remaining substantially stationary within the deck sleeve 12. The shock absorbing cushion roller means 40 rotatably engages the external side wall surface 32 of steel liner 50 causing the roller means 40 to rotate about their shafts, as described further below, as steel liner 50 rotates with drill pipe 28. The cushion roller means 40 absorbs and buffers vertical and lateral movements of steel liner 50 within outer shell 30.

Figure 2:
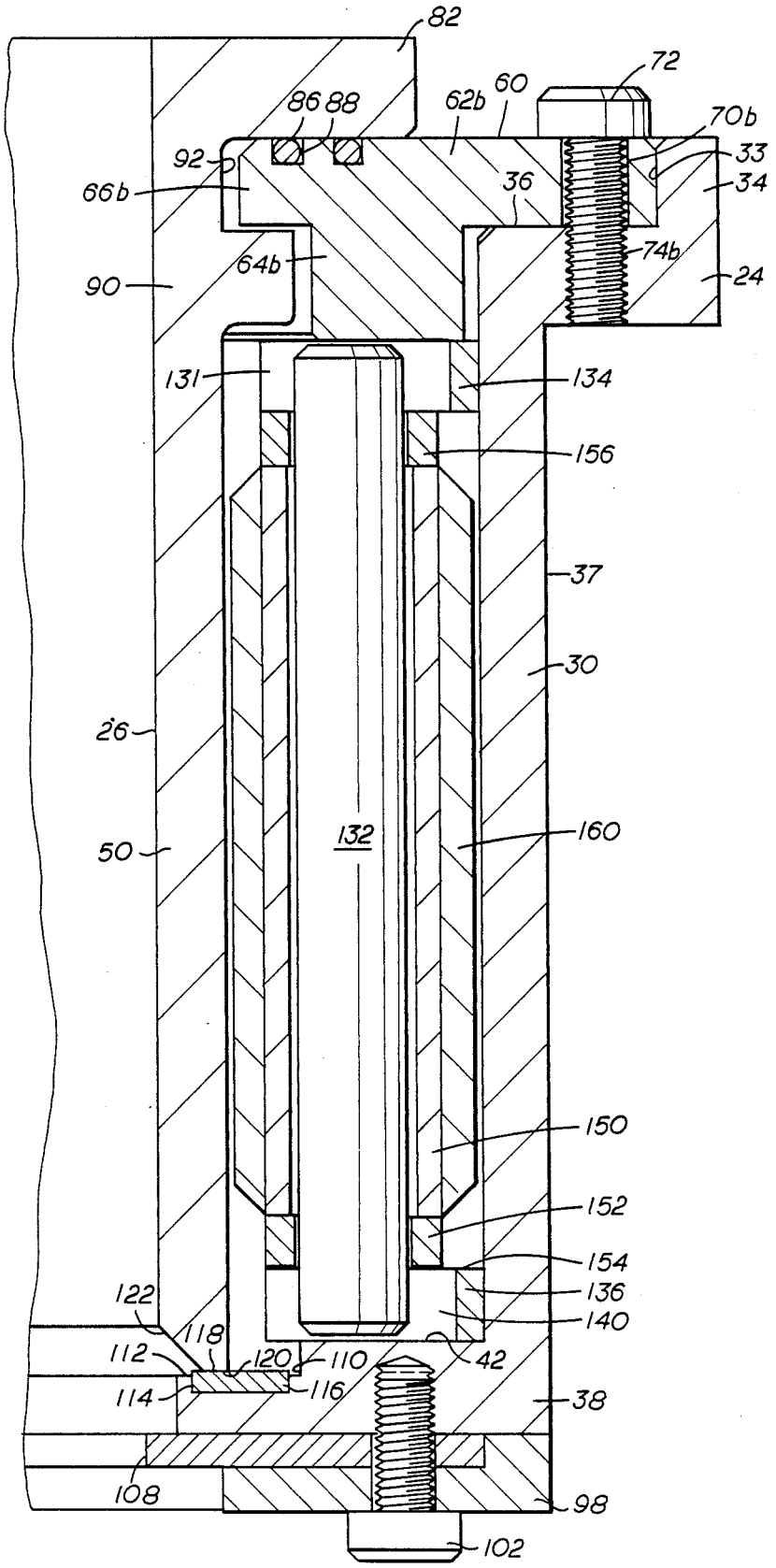
FIG. 2 is an enlargement of the right hand portion of the vertical sectional view of FIG. 1.

With reference now to FIG. 2, as well as FIG. 1, for added clarity, flange 24 includes a vertically upwardly projecting, circumferentially extending raised edge portion 34 at its radially outer periphery. The upper face of the outer shell 30 between the radially inner side wall surface 33 of raised edge portion 34 and the inner side wall surface 35 of tubular body portion 37 of outer shell 30 forms an annular, upwardly facing upper shoulder 36. At the lower end of tubular body portion 37 of outer shell 30, there is disposed a radially inwardly projecting annular flange 38 forming an upwardly facing annular lower shoulder 42. Upper and lower shoulders 36, 42 support the split retainer plate and the slotted cage for the cushion roller means 40 as hereinafter described.

An annular split retainer plate 60 comprising a pair of semicircular annular plate halves **62*a* and 62*b* (FIG. 3) is mounted on the upper end of outer shell 30. Each of the retainer plate halves 62*a*, 62*b* comprise a substantially semicircular cylindrical body portion 64*a*, 64*b*, a radially inwardly projecting semicircular flange 66*a*, 66*b* around the upper inner periphery of the body portions 64*a*, 64*b*, respectively, and a radially outwardly projecting semicircular flange 68*a*, 68*b* around the upper outer periphery of the body portions 64*a*, 64*b*, respectively. Body portions 64*a*, 64*b* are loosely telescoped into the upper end of bore 35 of outer shell 30. Each of the retainer plate halves 62*a*, 62*b* has a plurality of longitudinally axially extending, circumferentially spaced apart bores 70*a*, 70*b*, respectively, near its radially outer edge for receiving bolts 72 which are threadedly received in threaded bores 74*a*, 74*b*, respectively, in the midportion of flange 24. Bolts 72 securely fasten retainer plate 60 to outer shell 30**.

The inner liner 50 includes a substantially circular cylindrical tubular body 80 with a radially outwardly projecting flange 82 around its upper outer periphery. Flange 82 rests on and is supported by the substantially flat upper face **84*a*, 84*b* of retainer plate 60. A pair of annular sealing members 86 are disposed in annular grooves 88 in the upper face of retainer plate 60 for sealing engagement against the lower face of flange 82. Sealing members 86 preferably form a low pressure, dynamic environmental seal between retainer plate 60 and inner liner 50. Sealing members 86 may be made of any suitable elastomeric material such as, for example, natural or synthetic rubber, and may be of an O-ring or a lip seal-type construction, for example. Seals 86 preferably form a seal between liner 50 and retainer plate 60 which is capable of keeping mud or other fluids, dirt, chips, trash, and debris or the like out of the interior of deck bushing 10 and away from roller means 40 during drilling operations when the inner liner 50 is rotating with the drill pipe and the bushing 10** is subjected to the vibrations encountered in service.

Liner 50 includes a second radially outwardly projecting flange 90 around its upper outer periphery below and axially spaced apart from flange 82. Flange 90 is not as great in radial width as flange 82; flange 82 projects radially outwardly a greater distance than flange 90. There is an annular channel 92 around the circumference of steel liner 50 formed by the upper face of flange 90, the lower face of flange 82, and the portion of the exterior wall 32 of liner 50 between flanges 82, 90. Flanges **66*a*, 66*b* of retainer plate 60 are received and captured in channel 92 when bushing 10 is assembled, and prevent liner 50 from being removed in an axial direction from bushing 10. Thus, liner 50 will not climb or ride up the drill pipe as sometimes it would otherwise tend to do during rotation of the pipe in service, for example, if the liner were to momentarily catch or get stuck on the pipe. There is a radial clearance between the portion of side wall 32 which forms the end wall of channel 92 and the radially inner face of flanges 66*a*, 66*b*. There is also a radial clearance between the radially inner wall surfaces of cylindrical body portions 64*a*, 64*b* of retainer plate 60. These radial clearances permit the inner liner 50** to deflect laterally to a limited extent as the drill pipe impacts against it during service.

At the lower end of deck bushing 10, an annular end plate or cap 98 is mounted on the underside or lower annular face of flange 38 of outer shell 30. End plate or cap 98 is provided with a plurality of circumferentially spaced apart, longitudinally axially extending bores 100 therethrough for receiving a plurality of bolts 102 which are threadedly received in threaded blind bores 104 in the lower face of flange 38. End plate 98 has an upwardly projecting rim or boss 106 on its upper surface around its radially outer periphery for abutting engagement with the lower end face of flange 38. An annular gasket 106 of natural or synthetic rubber or the like is disposed between end plate 98 and flange 38 radially inwardly of rim 106. Gasket 10 is axially thicker in its uncompressed state than the height of rim 106 above the adjacent upper face of end plate 98 against which gasket 108 bears, so that the gasket is somewhat compressed between end plate 98 and flange 38 when the end plate is mounted on the flange. Gasket 108 is provided with a plurality of radially extending, circumferentially spaced apart slits or splits therein so that the drill pipe can easily stab through the gasket in use. Gasket 108 is sized so that its radially inner edge brushes or bears lightly against the surface of the grill pipe. Gasket 108 serves as a dust and chip deflector for the deck bushing.

Above end plate 98 and gasket 108 there is an axially extending counterbore 110 in flange 38 which extends downwardly from the upper face of the flange along a portion of its axial height and terminates in an upwardly facing annular shoulder 112. An annular groove 114 is disposed in the upper face of shoulder 112 near its radial midportion. Groove 114 is nearly as great in radial with as shoulder 112. An annular bearing member 116 is disposed in a tight fitting relationship in groove 114 and has an axial height greater than the axial depth of the groove, so that the flat upper face 118 of bearing member 116 extends upwardly beyond the adjacent surfaces of the face of shoulder 112. The lower end face 120 of inner steel liner 50 rests on and is supported by the flat upper face 118 of bearing member 116. The inner periphery of the lower end of inner steel liner 50 is chamfered, as at 112, between the bore wall 26 and the lower end face 120. Bearing member 116 is preferably made of a tough, hard, and durable plastic material with a low coefficient of friction on steel, such as, for example, Delrin, an acetal homopolymer resin manufactured by E.I. du Pont de Nemours & Co., Inc., of Wilmington, Del. Bearing member 116 provides a smooth, relatively slippery, but hard and durable surface on which inner steel liner 50 rotates with the drill pipe during drilling operations. Bearing member 116 also acts as a type of environmental seal to keep dirt, chips, trash, and debris out of the interior of deck bushing 10 and away from cushion roller means 40.

Figure 3:
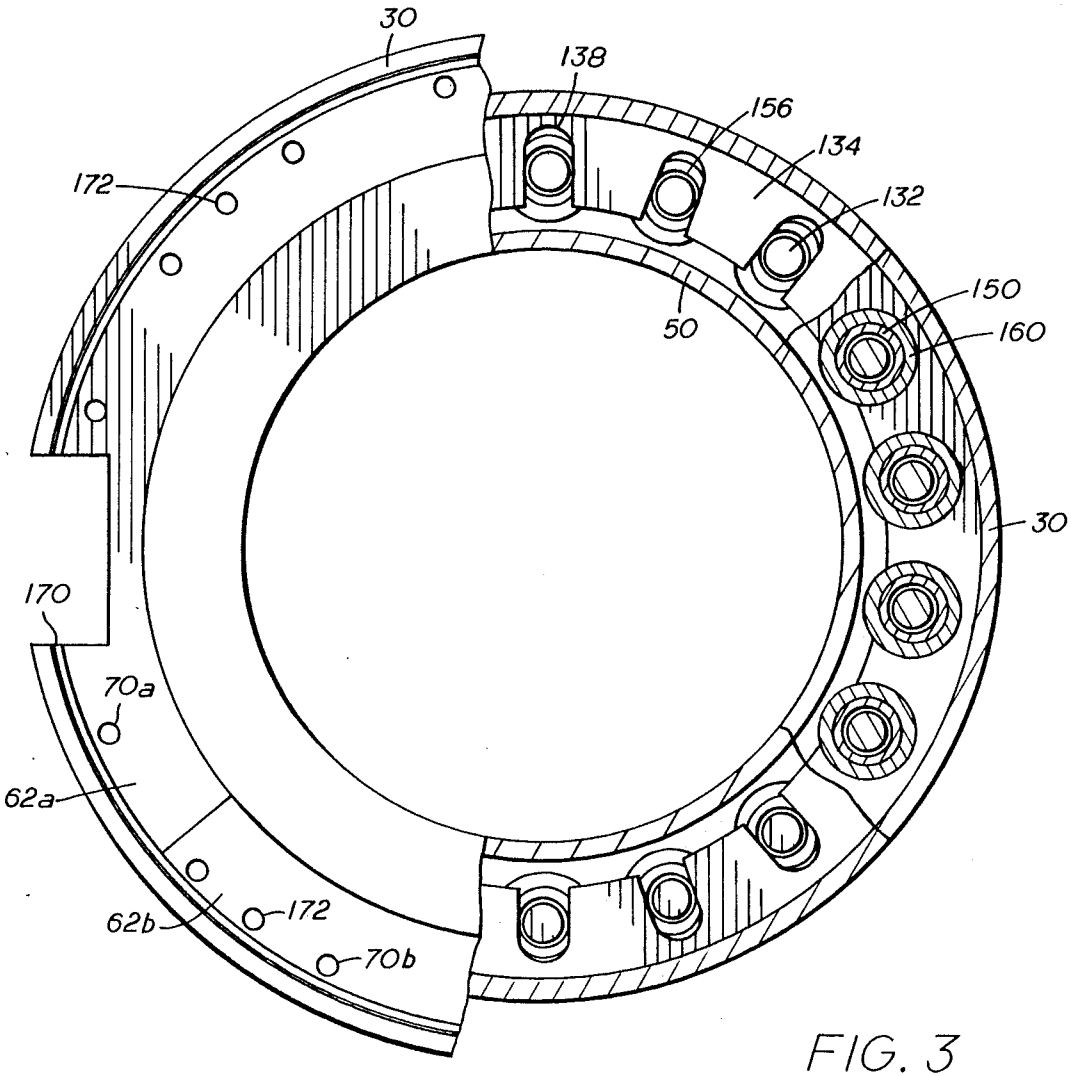
FIG. 3 is a plan view, partly in horizontal section taken along the section lines 3—3 of FIG. 1, of the roller deck bushing shown in FIG. 1.

With reference now to FIG. 3, as well as FIG. 1 and FIG. 2, for added clarity, shock absorbing cushion roller means 40 includes a plurality of vertically disposed roller assemblies 130 mounted in the annular space between the outer side wall 32 of inner liner 50 and the inner bore wall 35 of outer shell 30. Roller assemblies 130 each include a solid, circular cylindrical shaft 132 retained at its upper end in an upper slotted cage 134 and at its lower end in a lower slotted cage 136. Each of the upper and lower slotted cages 134, 136 includes an annular body with substantially flat upper and lower faces and a circular cylindrical radially outer wall surface. The cages 134, 136 are each provided with a plurality of circumferentially spaced apart, radially extending U-shaped openings or slots 138, 140, respectively, opening into their radially inner wall surfaces. Slots 138, 140 each receive one of the roller shafts 132 therewithin, and are deeper in a radial direction than the diameter of the shafts so that the shafts are permitted to move radially back and forth to a limited extent in slots 138, 140 in response to lateral impacts on roller assemblies 130. This substantially reduces the impact load on roller shafts 132.

Shafts 132 of roller assemblies 130 are substantially constrained from other than minimal lateral or side-to-side movements toward or away from an adjacent roller assembly, by the close fit of the roller shafts 132 in the slots in such lateral directions. Shafts 132 are also substantially constrained from other than minimal axial movements by the lower faces of cylindrical body portions **64*a*, 64*b* of retainer plate 60 and the upper face of lower shoulder 42. Shafts 132** are free to rotate, however, about their longitudinal axes, and do so in service as described further below.

Lower cage 136 is disposed on and supported by lower shoulder 42, and is lightly welded to outer shell 30. Each roller shaft 132 is loosely disposed within a tubular steel sleeve 150, the sleeves being greater in inside diameter than the outside diameter of the roller shafts, shorter in axial length than the roller shafts, and substantially centered on the shafts in relation to their upper and lower ends. A lower annular thrust washer 152 made, for example, of 4815 or 4820 carbon steel, is disposed on and supported by the upper face 154 of lower cage 136 around each shaft 132. Sleeves 150 rest on and are supported by lower thrust washer 152. An upper annular thrust washer 156 also made, for example, of 4815 or 4820 carbon steel, is disposed on and is supported by the upper end of sleeve 150 for which roller assembly 130. Upper slotted cage 134 rests atop and is supported by the upper annular thrust washers 156. Upper slotted cage 134 is constrained against axial movements by thrust washer 156 and the lower faces of cylindrical body portions **64*a*, 64*b***.

A cushion coating or cushion sleeve 160 is bonded or otherwise attached to the outer wall surface of sleeve 150 for each roller assembly. The outer surface of cushion sleeves 160 contact the outer wall surface 32 of inner liner 50 when the liner is laterally jarred, jolted, bounced, vibrated, or otherwise forced toward the roller assemblies by the drill pipe during use. Roller assemblies 130 are each free to rotate with the drill pipe and liner 50 when such impacts occur. Rotation of cushion sleeves 160 when contacting rotating liner 50 also causes rotation of shafts 132 and hardened thrust washers 152, 156. Cushion sleeves 160 also absorb and cushion the shocks of the lateral leads imparted by the drill pipe and liner 50 in use. Cushion sleeves 160 contact the inner bore wall 35 of outer shell 30 when roller assemblies 130 are forced radially outwardly by lateral impact loads. Cushion sleeves 160 should preferably be made of tough, flexible, resilient, durable material having good shock absorbing qualities and good abrasion resistance such as, for example, an elastomer such as a natural or synthetic rubber, or a plastic such as urethane. When the roller assemblies 130 are impacted laterally by the liner 50, the cushion sleeves 160 substantially absorb and dampen the shocks and only such dampened or reduced shocks are transmitted to the outer shell 30 and then to the drill deck 20 through bucket 12. When loads having axial as well as lateral components are transmitted to roller assemblies 130, cushion sleeves 160 also substantially absorb and dampen such axial load components, only such dampened or reduced impact loads being transmitted through hardened thrust washers 152, 156 to slotted cages 136, 134, respectively, and then to outer shell 30 and retainer plate 60. It should be noted that when the roller assemblies 130 are in place between liner 50 and outer shell 30 and there is no lateral loading of rotation of liner 50, e.g. when there are no drilling operations underway, the roller assemblies are not preloaded by any mechanical means. This enhances the shock absorbing capabilites of the roller assemblies by reducing the loads to which they are subjected in service.

As shown in FIG. 3, the outer shell 30 and retainer plate 60 have pair of diametrically opposed slots or ears 170 in their radially outer peripheries for receiving stop blocks or lugs (not shown) mounted on the bucket 12 or drill deck 20, e.g. by welding, for preventing rotation of the outer shell of the deck bushing 10 with respect to the bucket or drill deck. The flat upper face of retainer plate 60 is provided with a plurality of circumferentially spaced apart, axially extending threaded jacking holes 172 near the radially outer periphery of plate halves **62*a*, 62*b* for receiving external threaded jacking means (not shown) for lifting inner liner 50 and retainer plate 60 out of outer shell 30 or lowering liner 50 and plate 60 into shell 30**, as desired.

In the event that either or both of the inner liner 50 and cushion roller means 40 are desired or required to be repaired or replaced, such repairs or replacement can easily be effected at the job site or otherwise in the field, with minimal downtime or job interruption. Bolts 72 are removed, liner 50 and retainer plate 60 are lifted or jacked out of outer shell 30, and any or all of the roller assemblies 130 may then be removed in a radially inward direction from their slotted cages and repaired or replaced, as the case may be. Bearing member 116 may also be replaced at that time, if desired or required. Gasket 108 is also easily field replaceable by removing bolts 102 and end cap 98, whether or not liner 50 and retainer plate 60 are also removed at that time.

Preferably the deck bushing 10 will include about eighteen of the roller assemblies 130, but more or less may be used, depending upon the size of the bushing and rollers and so long as the desired vibration shock absorbing and dampening results are obtained. Outer shell 30 and retainer plate 60, as well as end cap 98 and roller shafts 132, are preferably made of a strong, durable metal such as any of the common steels typically used for drilling machinery of the type referred to herein. Inner liner 50 may also be made of any of such steels, but it is additionally preferred that the steel used for liner 50 have a relatively hard, smooth surface which is highly resistant to galling or marring, and that it exhibit good corrosion resistance.

While a preferred embodiment of the invention has been shown and described, it is merely exemplary of the invention. In view of the foregoing description and the accompanying drawings, modifications of the invention will occur to and may be made by those skilled in the art without departing from the spirit and scope of the invention as set forth in the claims.

I claim:

1. A shock absorbing guide bushing mountable in the drill deck of a drilling rig, comprising:

a generally tubular outer shell adapted to be nonrotatably mounted in the drill deck;

a generally tubular inner liner substantially coaxially and rotatably mounted within and spaced apart said outer shell forming an annular space therebetween, said inner liner having an inner bore adapted for receiving and guiding a drill string extending through the drill deck;

shock absorbing cushion roller means disposed in said annular space between said inner liner and said outer shell for cushioning and absorbing lateral impact loads imparted to said inner linear by the drill string; and first retainer means disposed on said outer shell and engageable with second retainer means disposed on said inner liner for permitting said inner liner to rotate with respect to said outer shell while preventing axial separation of said outer shell and said inner liner.

2. A shock absorbing guide bushing according to claim 1, wherein the engagement of said first and second retainer means permits limited transverse movement of said inner liner with respect to said outer shell.

3. A shock absorbing guide bushing according to claim 1, wherein:

said second retainer means includes a first radially outwardly projecting annular flange around the upper outer periphery of said inner liner, and a second radially outwardly projecting annular flange around the upper outer periphery of said inner liner, axially spaced apart from and below said first outwardly projecting annular flange; and said first retainer means includes an annular retainer plate nonrotatably and removably mounted on the upper end of said outer shell, said retainer plate having a radially inwardly projecting annular flange around its inner periphery, said inwardly projecting flange extending between said first and second outwardly projecting flanges of said inner liner, said inwardly projecting flange of said retainer plate being captured between said first and second flanges of said inner liner and preventing the axial separation of said inner liner from said outer shell.

4. A shock absorbing guide bushing according to claim 3, wherein said retainer plate includes an annular cylindrical body extending downwardly from said inwardly projecting flange and telescopingly received in the upper end of said outer shell, and wherein there is a radial clearance between the radially inner surface of said inwardly projecting flange and the adjacent exterior side wall surface of said inner liner, and there is a radial clearance between the radially outer surface of said second annular flange of said inner liner and the adjacent radially inner side wall surface of said cylindrical body of said retainer plate, thereby permitting limited relative transverse movement between said inner liner and said outer shell.

5. A shock absorbing guide bushing according to claim 4, wherein said retainer plate has a radially outwardly projecting annular flange around its upper exterior periphery, said outwardly projecting flange of said retainer plate being supported on and removably attached to the upper end of said outer shell.

6. A shock absorbing guide bushing according to claim 4, wherein said first outwardly projecting flange of said inner liner is disposed on and supported by the upper face of said retainer plate, and including a seal member disposed in an annular groove in the upper face of said retainer plate for sealingly engaging said first flange.

7. A shock absorbing guide bushing according to claim 4, wherein said retainer plate is a split plate comprising a pair of mated semicircular plate halves.

8. A shock absorbing guide bushing according to claim 1, wherein said first retainer means is removably mounted on said outer shell, permitting the axial separation of said inner liner from said outer shell when removed.

9. A shock absorbing guide bushing according to claim 8, wherein said cushion roller means is removable from said annular space when said first retainer means and said inner liner have both been removed from said outer shell.

10. A shock absorbing guide bushing mountable in the drill deck of a drilling rig, comprising:

a generally tubular outer shell adapted to be nonrotatably mounted in the drill deck;

a generally tubular inner liner substantially coaxially and rotatably mounted within and spaced apart from said outer shell forming an annular space therebetween, said inner liner having an inner bore adapted for receiving and guiding a drill string extending through the drill deck;

shock absorbing cushion roller means disposed in said annular space between said inner liner and said outer shell for cushioning and absorbing lateral impact loads imparted to said inner liner by the drill string;

wherein said inner liner is rotatable with the drill string, and said cushion roller means, when actuated by said inner liner being impacted by the drill string, are engageable with the exterior side wall surface of said inner liner and rotatable therewith.

11. A shock absorbing guide bushing mountable in the drill deck of a drilling rig, comprising:

a generally tubular outer shell adapted to be nonrotatably mounted in the drill deck;

a generally tubular inner liner substantially coaxially and rotatably mounted within and spaced apart from said outer shell forming an annular space therebetween, said inner liner having an inner bore adapted for receiving and guiding a drill string extending through the drill deck;

shock absorbing cushion roller means disposed in said annular space between said inner liner and said outer shell for cushioning and absorbing lateral impact loads imparted to said inner liner by the drill string;

wherein said inner liner transmits such lateral impact loads from the drill string to said cushion roller means, and wherein the portion of said cushion roller means disposed in the direction of such lateral impact loads engages said inner liner and cushions and absorbs such lateral impact loads, and wherein said portion of said cushion roller means also cushions and absorbs thrust loads imparted to said inner liner by the drill string along with such lateral impact loads.

12. A shock absorbing guide bushing mountable in the drill deck of a drilling rig, comprising:

a generally tubular outer shell adapted to be nonrotatably mounted in the drill deck;

a generally tubular inner liner substantially coaxially and rotatably mounted within and spaced apart from said outer shell forming an annular space therebetween, said inner liner having an inner bore adapted for receiving and guiding a drill string extending through the drill deck;

shock absorbing cushion roller means disposed in said annular space between said inner liner and said outer shell for cushioning and absorbing lateral impact loads imparted to said inner liner by the drill string, said shock absorbing cushion roller means including a plurality of vertically disposed cushion roller assemblies circumferentially spaced apart around the exterior side wall of said inner liner in said annular space, each of said cushion roller assemblies including a roller shaft;

a cushion coating support sleeve loosely disposed around said roller shaft, the upper and lower ends of said roller shaft protruding from said sleeve; and a shock absorbing cushion coating affixed to the exterior surface of said sleeve, said coating having an outside diameter slightly smaller than the radial width of said annular space between said inner liner and said outer shell.

13. A shock absorbing guide bushing according to claim 12, and further including an upper slotted cage and a lower slotted cage disposed in such annular space for receiving the upper and lower ends, respectively, of said roller shafts, each of said slotted cages including an annular body having a plurality of radially extending, circumferentially spaced apart U-shaped slots therein opening into the radially inner wall surface of said body, each of the roller shafts being received in a separate, axially aligned pair of said slots in said upper and lower cages, said slots permitting limited radial movement of said roller shafts therewithin and allowing freedom of said roller shafts to rotate about their axes, but substantially preventing each of said cushion roller assemblies from moving in a side-to-side direction toward an adjacent cushion roller assembly.

14. A shock absorbing guide bushing according to claim 13, and further including an upper annular thrust washer disposed around said roller shaft near its upper end on the upper end of said sleeve between said sleeve and the lower face of said upper slotted cage, and a lower annular thrust washer disposed around said roller shaft near its lower end on the upper face of said lower slotted cage between said lower slotted cage and the lower end of said sleeve.

15. A shock absorbing guide bushing according to claim 13, wherein said outer shell includes a radially inwardly extending annular flange around its lower end, said flange having an upwardly facing annular shoulder on which said lower slotted cage is disposed.

16. A shock absorbing guide bushing according to claim 15, wherein said lower slotted cage is nonrotatably mounted on said annular shoulder of said flange.

17. A shock absorbing guide bushing according to claim 15, wherein said upwardly facing annular shoulder has an annular counterbore around its radially inner periphery forming a second upwardly facing annular shoulder, said second annular shoulder including a centrally disposed annular groove therein, and including an annular bearing member disposed in said annular groove for supporting the lower end of said inner liner.

18. A shock absorbing guide bushing according to claim 15, and further including:

an annular end plate mounted on the underside of said inwardly extending annular flange, said end plate having an upwardly extending boss around its radially outer periphery for engaging said flange, there being an annular gasket receiving space radially inward of said boss between said end plate and said flange; and an annular flexible gasket means mounted in said annular gasket receiving space for deflecting debris from drilling operations away from said bushing, said annular flexible gasket means including a gasket member having an inside diameter not substantially larger than the outside diameter of the drill string and having a plurality of radially extending slits therein for facilitating stabbing of the drill string through said gasket member.

19. A shock absorbing guide bushing according to claim 12, wherein said shock absorbing cushion coating comprises a tough, flexible, resilient, durable material having good shock absorbing qualities and good abrasion resistance.

20. A shock absorbing guide bushing according to claim 19, wherein said cushion coating comprises natural or synthetic rubber.

21. A shock absorbing guide bushing according to claim 19, wherein said cushion coating comprises urethane plastic.

22. A shock absorbing guide bushing according to claim 12, wherein said cushion coating covers substantially the entire surface of said sleeve.

23. A drill deck shock absorbing guide bushing, comprising:

an outer shell nonrotatably mounted in the drill deck;

an inner liner rotatably mounted within, and substantially coaxial with, the outer shell, the inner liner having a central axial bore adapted for receiving and guiding a drill string extending therethrough, there being an annular chamber between the outer shell and the inner liner;

a split retainer plate removably mounted on the upper end of said outer shell, said split retainer plate having an inwardly projecting annular flange around its radially inner surface disposed and captured between a pair of radially outwardly projecting annular flanges around the upper exterior surface of said inner liner, said flanges preventing the axial separation of said inner liner and outer shell while permitting relative rotation therebetween; and a plurality of shock absorbing cushion roller assemblies vertically disposed in said annular chamber circumferentially spaced apart around said inner liner and engageable with said inner liner when said inner liner is moved toward said cushion roller assemblies due to impacts from the drill string, said cushion roller assemblies being rotatable with said inner liner and absorbing and cushioning the lateral and thrust loads imparted to said inner liner by the drill string.

24. A drill deck bushing according to claim 23, wherein there is a radial clearance between said retainer plate and said inner liner in the unloaded state of said bushing.

25. A drill deck bushing according to claim 23, wherein said inner liner and said cushion roller assemblies are axially removable from said bushing when said removable retainer plate has been removed from said outer shell.

* * * * *